US006792888B1

(12) United States Patent
Metcalf

(10) Patent No.: US 6,792,888 B1
(45) Date of Patent: Sep. 21, 2004

(54) WAKE TOWER AND METHOD OF MAKING SAME

(76) Inventor: Robert Metcalf, 8134 Lankershim Blvd., North Hollywood, CA (US) 91605

( * ) Notice: Subject to any disclaimer, the term of this patent is extended or adjusted under 35 U.S.C. 154(b) by 0 days.

(21) Appl. No.: 10/401,644

(22) Filed: Mar. 27, 2003

(51) Int. Cl.[7] ..... B63B 17/00
(52) U.S. Cl. ..... 114/364; 114/253
(58) Field of Search ..... 114/253, 343, 114/364

(56) References Cited

U.S. PATENT DOCUMENTS 3,034,470 A * 5/1962 Vanderfeltz et al. ..... 114/253
5,052,326 A * 10/1991 Wiggen et al. ..... 114/343
5,669,325 A * 9/1997 Feikema ..... 114/343
5,979,350 A * 11/1999 Larson et al. ..... 114/253
6,044,788 A * 4/2000 Larson et al. ..... 114/253
6,192,819 B1 * 2/2001 Larson et al. ..... 114/253
6,374,762 B1 * 4/2002 Larson et al. ..... 114/253

* cited by examiner

*Primary Examiner*—S. Joseph Morano
*Assistant Examiner*—Lars A. Olson
(74) *Attorney, Agent, or Firm*—James E. Brunton, Esq.

(57) ABSTRACT

An attractive wake tower assembly of a unique, generally U-Shaped configuration that can be readily pivotally mounted on powerboats of various constructions to enable the wake tower assembly to be pivoted from an upstanding to a lowered position. The wake tower assembly is of a high-strength, simple construction that does not interfere with the visibility of the boat operator. Each of the side members of the assembly has an upper portion and a lower portion, each of which is generally oval in cross section. The lower portion of each of the side members have a first width and the upper portion of each of the sides having a second width less than the first width; and a bight portion interconnecting the upper portions of the sides, the bight portion being generally circular in cross section.

15 Claims, 11 Drawing Sheets

58
56
54
53
W-1
46
46a
51
48
38
W
5
5

D-1
84
82
SA
D-2
86
80
86
D-3

46
53
6
51
48
28
34
6
46a
56
54
58
42
53
42a
51
32
44
30
36
82a
W-1
E
D'
W-2
8a 46
48
62a
73
38
34
64a
72
62
64
60
51
76
8
9
7

B
A
110
15
15
106a
106
106a
16
16
34
108
48

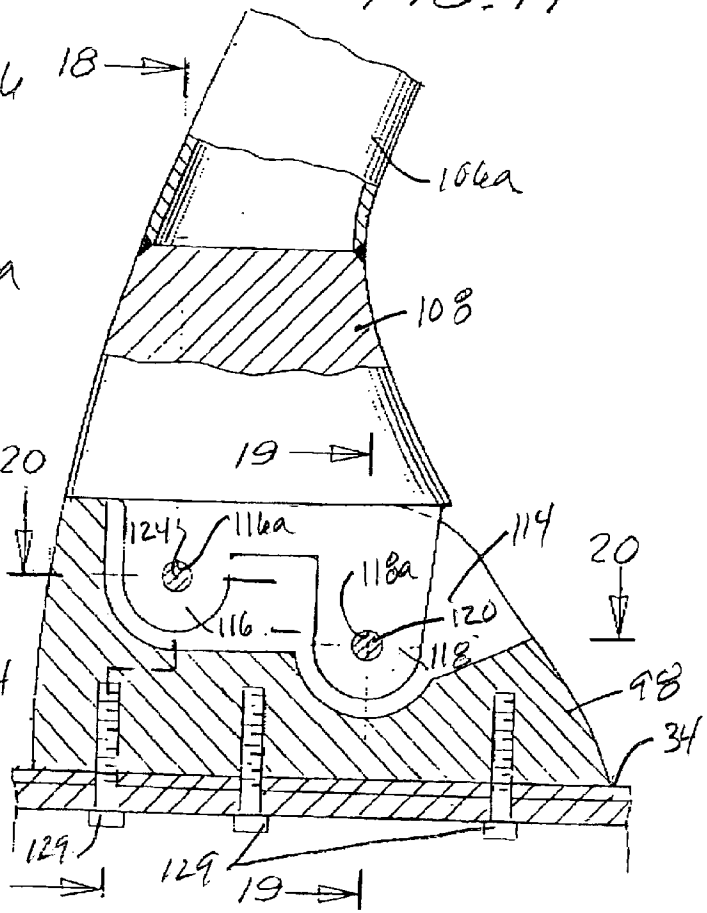
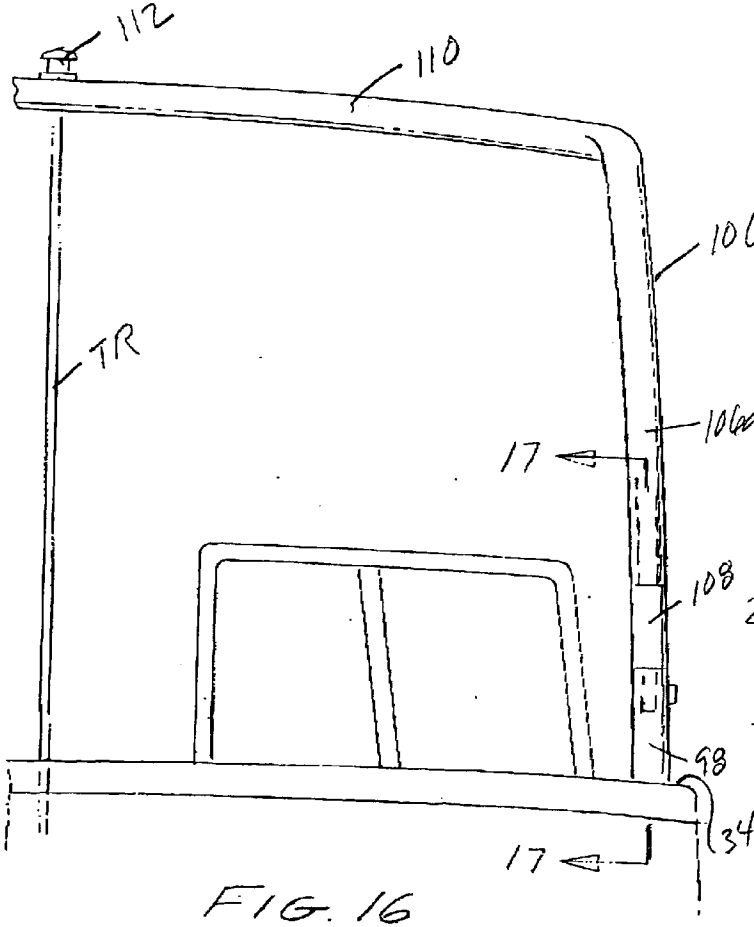
FIG. 16

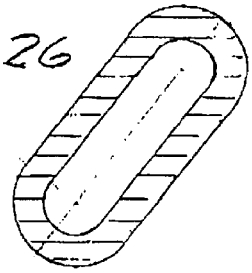
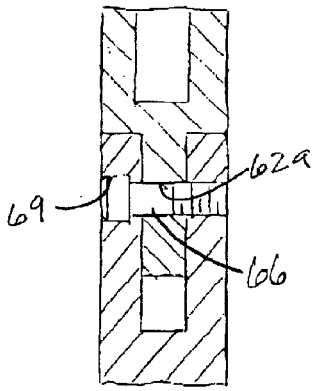
FIG. 27
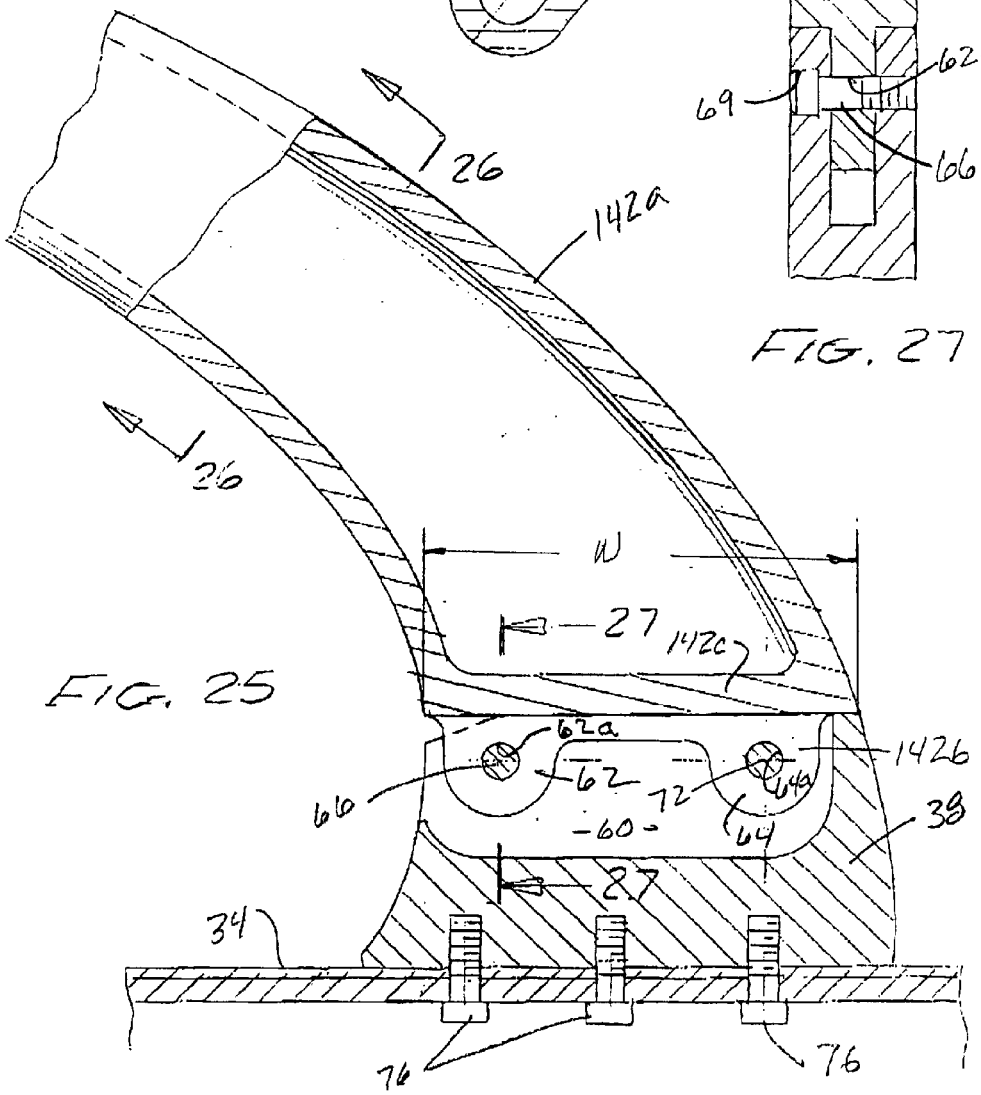
FIG. 25

WAKE TOWER AND METHOD OF MAKING SAME

BACKGROUND OF THE INVENTION

Field of the Invention

The present invention relates generally to water sports such as wakeboarding. More particularly, the invention concerns a wake tower of novel construction for use with powerboats for towing a performer behind the boat using a towrope that is connected to the wake tower.

In recent years the sport of wakeboarding has become very popular. As the name implies, the wake boarder intentionally rides the wake of the boat and prefers to have as large wake as possible generated behind the boat. Experience has shown that to take full advantage of the wake generated by the boat, it is preferable to anchor the towline used to tow the wake boarder at a relatively high elevation above the deck of the boat. Accordingly, a large number of elevated wake towers of various constructions have been suggested in the past.

Typically, the prior art wake towers comprise a rather large and somewhat elaborate framework that is affixed to the boat deck. Such prior art wake towers are heavy and generally quite cumbersome to install and remove from the boat. Further, such towers may interfere with the boat's passage beneath bridges and other types of overpasses. Additionally, because of the complexity of the framework of several of the prior art wake towers, visibility of the operator of the boat can be impaired. Exemplary of somewhat typical types of prior art wake towers are those illustrated and described in U.S. Pat. No. 5,979,350 issued to Larson et al. and U.S. Pat. No. 6,193,819 issued to Larson et al.

To accommodate the overhead clearance problem exhibited by certain of the prior art wake towers, some prior art wake tower structures can be dismantled if necessary. However, such prior art structures often have questionable structural stability when erected and can present substantial safety hazards after being disassembled. For example, after the wake tower structures have been disassembled they can present a substantial tripping hazard to passengers on the boat especially when the boat is being rocked by waves. Further, in their dismantled configuration, the wake tower structures typically undesirably reduce the usable space on the boat deck.

Another approach to accommodating overhead clearance problems has been to construct a wake tower assembly that is pivotally interconnected with the gunwales of the boat so that the wake tower can be moved from an elevated position to a lowered position. Exemplary of this prior art approach, it is a wake tower assembly sold by the Titan Company of Rancho Cordova, Calif.

SUMMARY OF THE INVENTION

By way of summary, one form of the wake tower assembly of the present invention comprises a first base member that can be connected to the gunwale on one side of a power boat; a second base member that can be connected to the gunwale on the opposite side to of a power boat; a generally U-shaped, structural member having a first curved side connected to the first base member and a second curved side connected to the second base member, each of the sides having an upper portion and a lower portion each of which is generally oval in cross-section, the lower portion of each of the sides having a first width and the upper portion of each of the sides having a second width less than the first width; and a bight portion interconnecting the upper portions of the sides, the bight portion being either generally circular or generally oval in cross-section. In one form of the invention, the U-shaped structural member can be pivoted downwardly toward the bow of the powerboat and in another form of the invention the U-shaped structural member can be pivoted downwardly toward the stern of the boat.

With the foregoing summary in mind, it is an object of the present invention to provide a highly attractive wake tower assembly of a unique, generally U-shaped configuration that can be readily mounted on powerboats of various constructions.

Another object of the invention is to provide a wake tower assembly of the aforementioned character that is of a high-strength, simple construction that does not interfere with the visibility of the boat operator.

Another object of the invention is to provide a wake tower assembly of the character described that can be easily attached and detached from the powerboat.

Another object of the invention is to provide a wake tower assembly as described in the preceding paragraphs, which can be pivoted from a first upright position to a second lowered position.

Another object of the invention is to provide a wake tower assembly of the class described in which the U-shaped portion of the tower is fabricated from light weight metal tubing that is first swaged into a unique configuration and then is strategically formed to create high strength, gracefully curved side portions having a tapered, oval shape and a bight portion that is generally circular in cross-section.

Another object of the invention is to provide a wake tower assembly of the of the character described in which the U-shaped portion of the tower is cast by conventional metal casting techniques into a unique configuration having gracefully curved side portions that are generally oval shape in cross-section.

BRIEF DESCRIPTION OF THE DRAWINGS

FIG. 8 is in enlarged, cross-sectional view taken along lines 8—8 of FIG. 6.

FIG. 16 is a view taken along lines 16—16 of FIG. 14.

FIG. 17 is a greatly enlarged, cross-sectional view taken along lines 17—17 of FIG. 16.

FIG. 23 is an enlarged, cross-sectional view taken along lines 23—23 of FIG. 22.

FIG. 24 is a cross-sectional view taken along lines 24—24 of FIG. 23.

FIG. 25 is a greatly enlarged cross-sectional view of the area designated as "25" in FIG. 22.

FIG. 26 is a cross-sectional view taken along lines 26—26 of FIG. 25.

FIG. 27 is a cross-sectional view taken along lines 27—27 of FIG. 25

DESCRIPTION OF THE INVENTION

Figure 1:
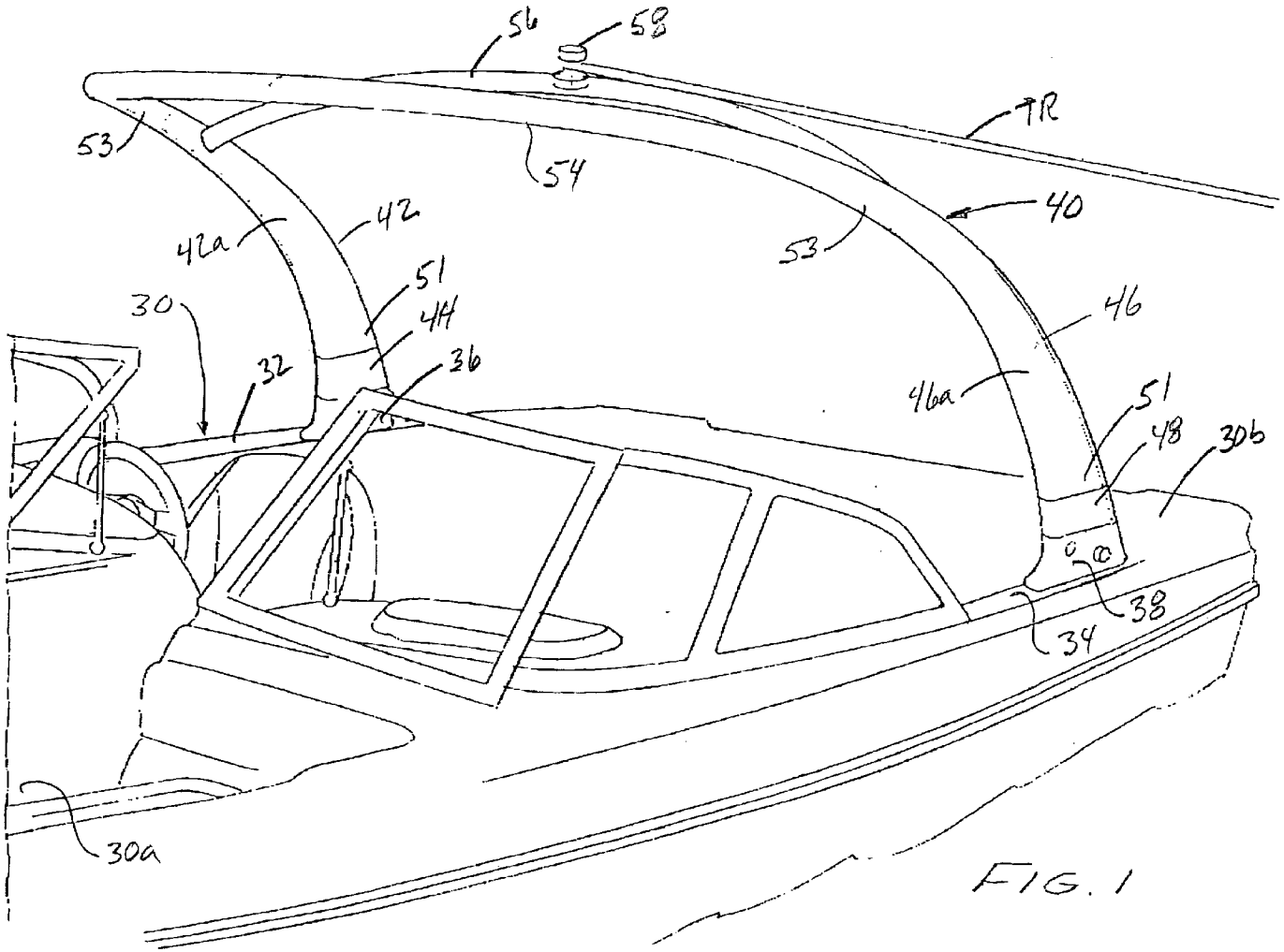
FIG. 1 is a generally perspective view of one form of the wake tower of the present invention shown affixed to the gunwales of a powerboat.
Figures 2, 4:
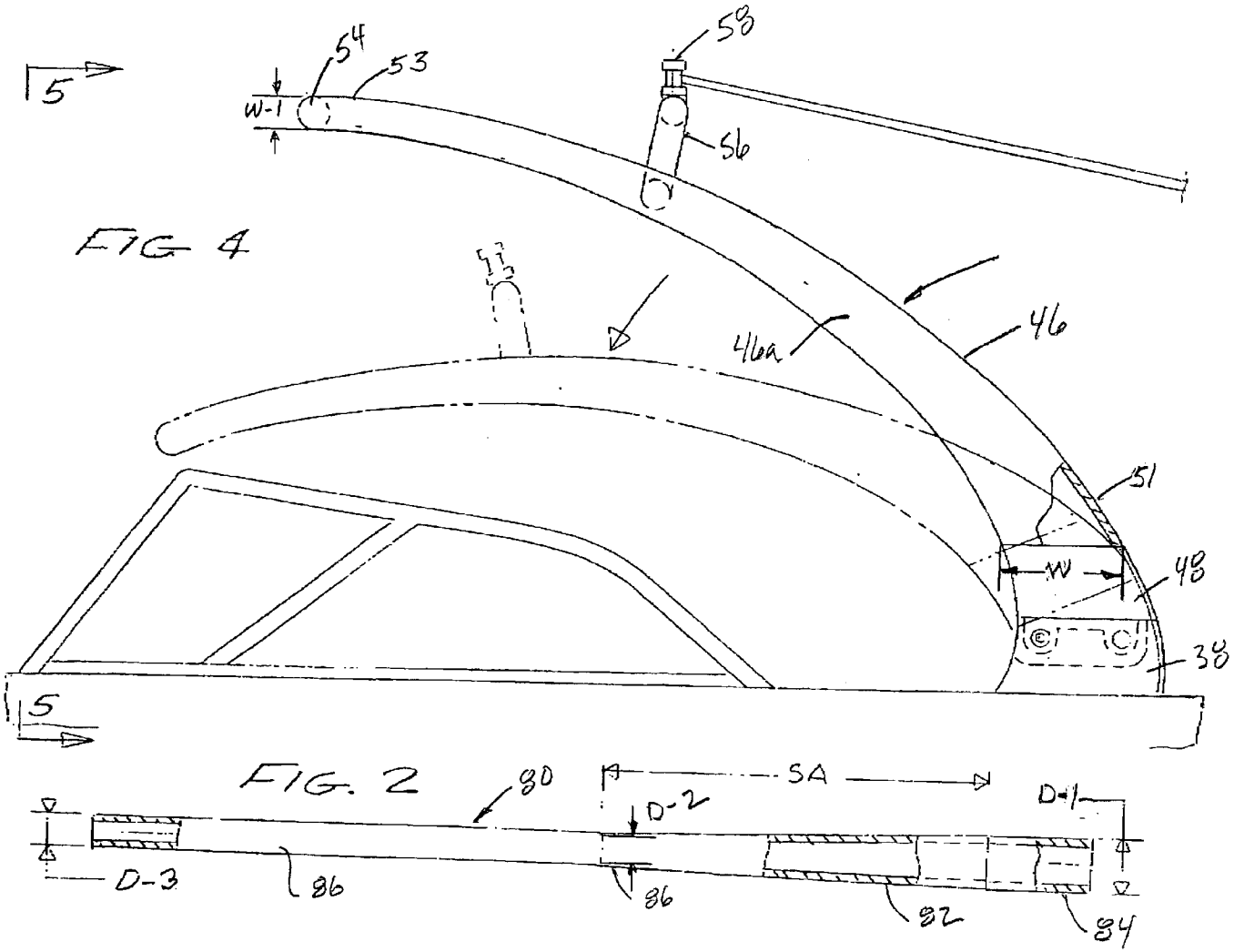
FIG. 2 is a top view, partly in cross-section, illustrating one form of the method of the invention for making the wake tower.
FIG. 4 is a side elevational view, partly broken away to show internal construction, of the form of the wake tower shown in FIG. 1.
Figures 3, 5:
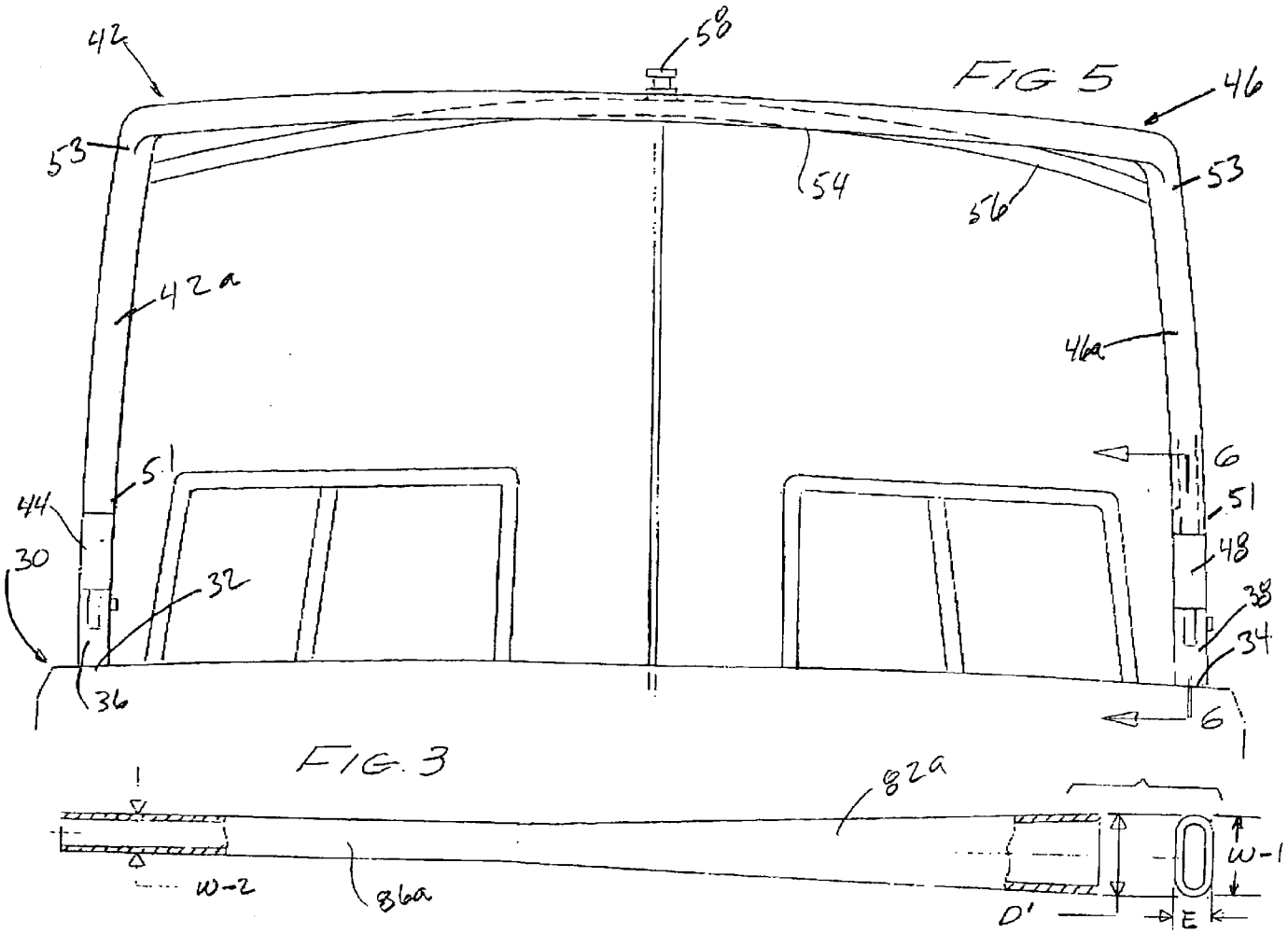
FIG. 3 is a side elevational view, partly in cross-section further illustrating the method of the invention for making the wake tower.
FIG. 5 is a view taken along lines 5—5 of FIG. 4.

Referring to the drawings and particularly to FIGS. 1, 4 and 5, one form of the wake tower of the invention is shown interconnected with a powerboat 30 of conventional construction having a bow portion 30*a* and a stern portion 30*b*. As best seen in FIG. 5, the powerboat also has first and second transversely spaced apart gunwales 32 and 34 respectively to which the wake tower is connected. In the present form of the invention the wake tower includes an upwardly extending first base member 36 connected to the first gunwale 32 and an upwardly extending second base member 38 connected to said second gunwale 34. The base members 36 and 38 are of a curved configuration and are preferably cast from a lightweight metal such as aluminum.

Interconnected with the base members is a generally U-shaped, upwardly extending structural assembly generally designated by the numeral 40. The structural assembly 40 includes a generally "L" shaped structural member 42 having a first curved side 42*a* and a cast aluminum, first connector segment 44. Structural member 40*a* is connected to aluminum first connector segment 44 by any suitable means such as welding. In a manner presently to be described, connector segment 44 is, in turn, pivotally connected to first base member 36. Structural assembly 40 also includes a second generally "L" shaped structural member 46 having a curved side 46*a* and a second, cast aluminum connector segment 48 that is connected to second curved side 46*a* by any suitable means such as welding. Connector segment 48 is, in turn, pivotally connected second base member 38.

As will be discussed in greater detail hereinafter, each of the sides of structural assembly 40 is first swaged into the desired configuration and then is strategically formed to create a gracefully curved, tapered portion having an oval shape. More particularly, as best seen in FIGS. 1 and 4, each of the sides of the structural assembly 40 includes a lower portion 51 having a first width W and an upper portion 53 having a second width W-1 that is substantially less than said first width W. structural assembly 40 further includes a bight portion 54 interconnecting upper portions 53 of the sides. As indicated in FIG. 4, bight portion 54 is generally circular in cross-section. However, it is to be understood that, for certain applications, bight 54 can be oval in cross-section.

In the form of the invention shown in FIGS. 1 through 11, the wake tower further includes a tow rope connector member 56 that is connected to and spans upper portion 53 of the sides 42 and 46. Connected to the connector member 56 is a conventional type of connector 58 to which the towrope "TR" can be connected.

Figures 5, 6, 7:
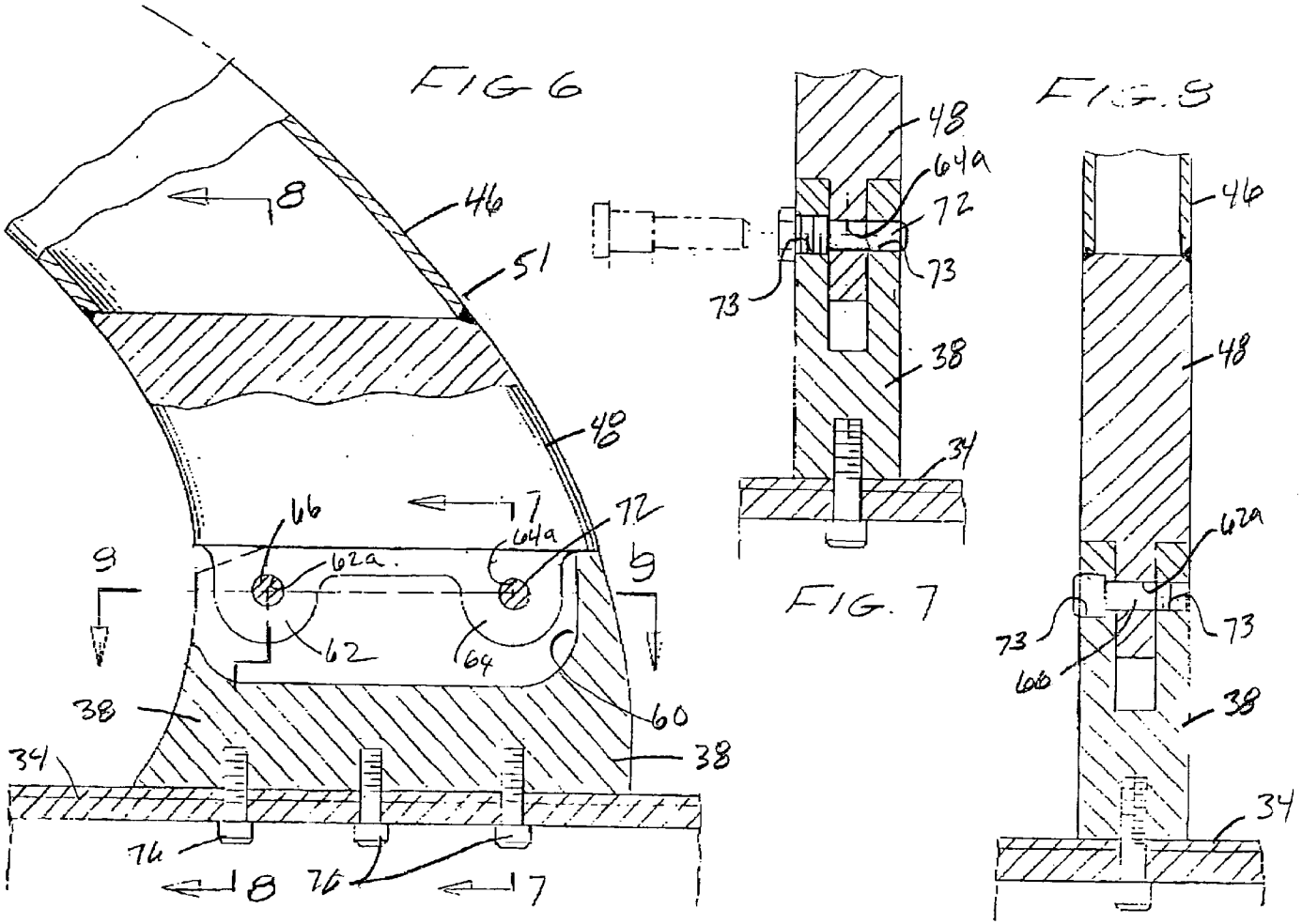
FIG. 6 is a greatly enlarged, cross-sectional view taken along lines 6—6 of FIG. 5.
FIG. 7 is an enlarged, cross-sectional view taken along lines 7—7 of FIG. 6.

Turning next to FIGS. 6, 7 and 8, a portion of one side of the wake tower of the invention is there shown. It is to be understood that the other side of the wake tower is of a similar construction, but is not shown in the drawings in order to simplify the specification. Each of the base members is provided with a cavity 60 and each of the connector segments is provided with a pair of spaced apart, downwardly extending ears 62 and 64 that are receivable within the base member cavities. As shown in FIG. 6, downwardly extending ear 62 has a bore 62*a* formed therein. Similarly, downwardly extending ear 64 has a bore 64*a* formed therein. Receivable within bore 62*a* is a pivot pin 66 about which side 46 and connector segment 48 can pivot in the manner shown in FIG. 11.

Figure 10:
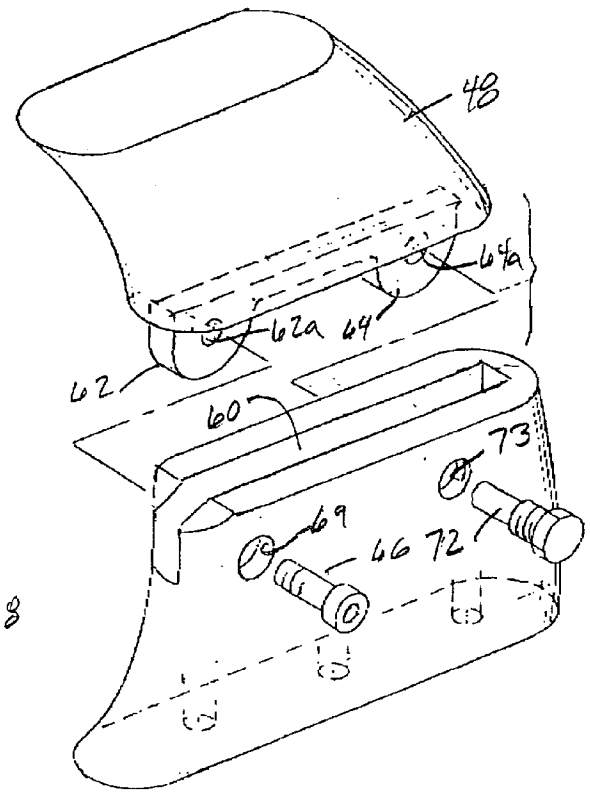
FIG. 10 is a generally perspective, exploded view of one of the base members and one of the connecting segments of the wake tower of the invention.
Figure 9:
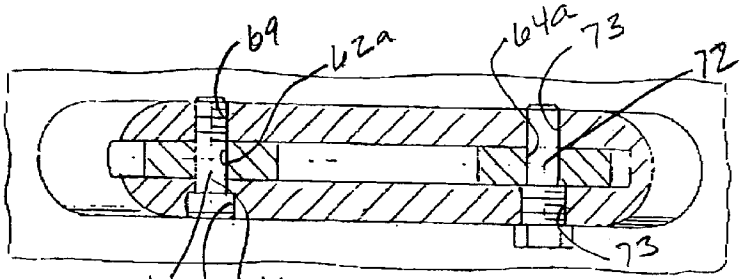
FIG. 9 is in enlarged, cross-sectional view taken along lines 9—9 of FIG. 6.
Figure 11:
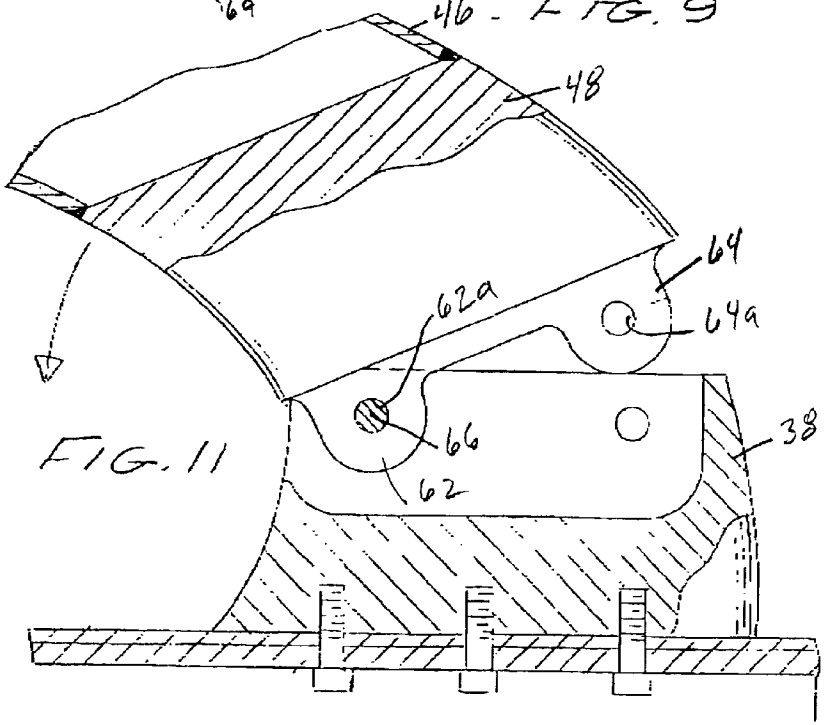
FIG. 11 is a fragmentary cross-sectional view of the lower portion of one side of the wake tower of the invention illustrating the manner in which the wake tower pivots relative to the base member.

As illustrated in FIGS. 9 and 10, pivot pin 66 extends through aligned bores 69 formed in base member 38. Similarly, a locking pin 72 is receivable within bore 64*a* formed in ear 64. Pivot pin 66 extends through aligned bores 73 formed in base member 38 and, when in position within these openings in the manner shown in FIGS. 6 in 9, prevents pivotal movement of side 46 and connector segment 48 about pivot pin 66. As indicated by the phantom lines in FIG. 7, when the locking pin 72 is removed from the base member, the combination of side 46 and connector segment 48 is free to pivot about pivot pin 66 in the manner shown in FIG. 11.

In accordance with one form of the method of making the wake tower illustrated in FIGS. 1 through 11, the first and second base members 36 and 38 are cast in a conventional manner from a suitable lightweight castable material such as aluminum and are appropriately finished. This done, the base members are interconnected with the powerboat by a plurality of threaded connectors 76 in the manner shown in FIG. 6.

The side members 42*a* and 46*a* are each formed individually by first heating a first length of tubing to an elevated, annealing temperature. This first length of tubing, which by way of example can be 6061-T6 aluminum tubing, that has a diameter of approximately 5 inches, a first end 80*a* and a second end 80*b*. In the manner illustrated in FIG. 2, the heated length of tubing is swaged by conventional technique well known to those skilled in the art to form a first swaged tube 80 having a tapered swaged portion 82. Swaged portion 82 has a first end 84 of first diameter D-1, a second end 86 of a second lesser diameter D-2 and a uniform diameter portion 86 having a diameter D-3 substantially equal to said second lesser diameter D-2.

Using an appropriate forming dye, the tapered swaged portion 82 of the swaged tube 82 is strategically formed to produce a tapered swaged portion 82*a* and an elongated uniform diameter portion 86*a* (FIG. 3). As illustrated in FIG. 3, swaged portion 82*a* is generally oval shaped in cross-section and has a thickness "E". Swaged portion 82*a* has a width W-1, while uniform diameter portion 86*a* has a lesser width W-2. This swaging step is done in a conventional manner using conventional tooling that is of the character well understood by those skilled in the art.

Following the swaging step, the swaged to first tube 80 is strategically bent into the desired shape to form a first bent tube that is generally "L" shaped in configuration and generally corresponds to the shape of member 42*a*.

Next, first connector segment 44 is cast in a conventional manner from a light weight castable material such aluminum and is connected by any suitable means such as welding to the bent tube formed by the swaging step to form a first wake tower subassembly 42, which generally corresponds to one-half of the structural assembly 40.

Following the forming of the first wake tower subassembly, a second length of aluminum tubing is swaged and formed in the identical manner described in the preceding paragraphs to produce a second side 46*a*. This done, second connector segment 48 is suitably cast from a light weight metal such as aluminum and is interconnected as by welding was second side 46*a* to form assembly 46 that generally corresponds to the second half of the structural assembly 40.

Next, the elongated, uniform diameter portions of the first and second wake tower subassemblies 42 and 46 are interconnected at their ends as by a welding to form the structural member 40.

After completion of the construction of the structural member 40 in the manner described in the preceding paragraphs, the structural member is pivotally interconnected with the base members 36 and 38 in the manner depicted in FIGS. 6 through 10 of the drawings to form the construction shown in FIGS. 1 and 3. More particularly, the ears formed on each of the connector segments are inserted into the base cavities, the pivot pins 66 are inserted into bores 69 and 62*a* and the locking pins are inserted into bores 73 and 64*a*. With this construction, when it is desired to pivot the structural member into the forwardly stowed position in the manner illustrated in FIG. 11, locking pin 72 are removed from bores 73 and 64*a* to permit the structural member to pivot about pivot pins 66.

Figure 12:
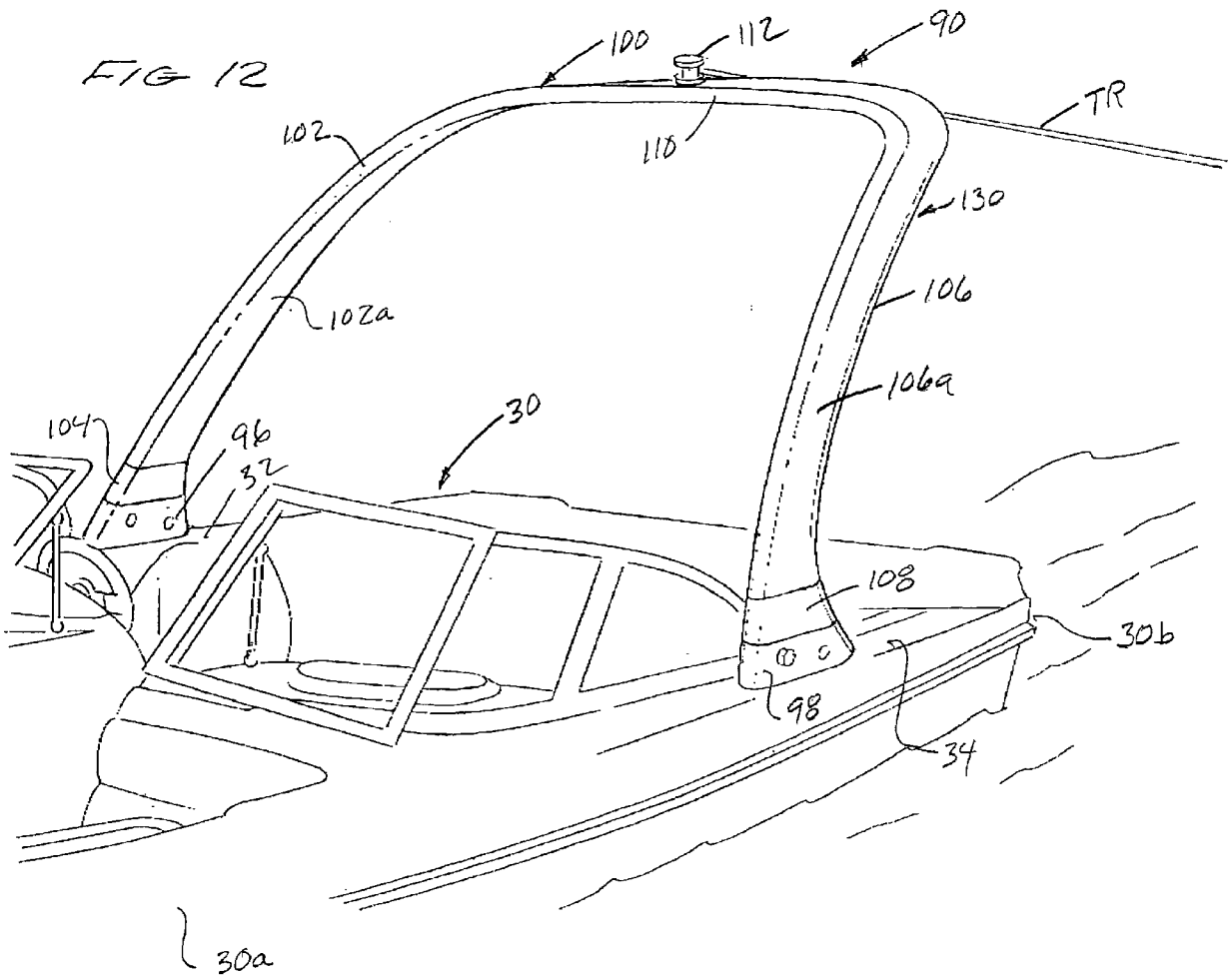
FIG. 12 is a generally perspective view of an alternate form of wake tower of the present invention shown mounted on the gunwales of a powerboat.
Figures 13, 14, 15:
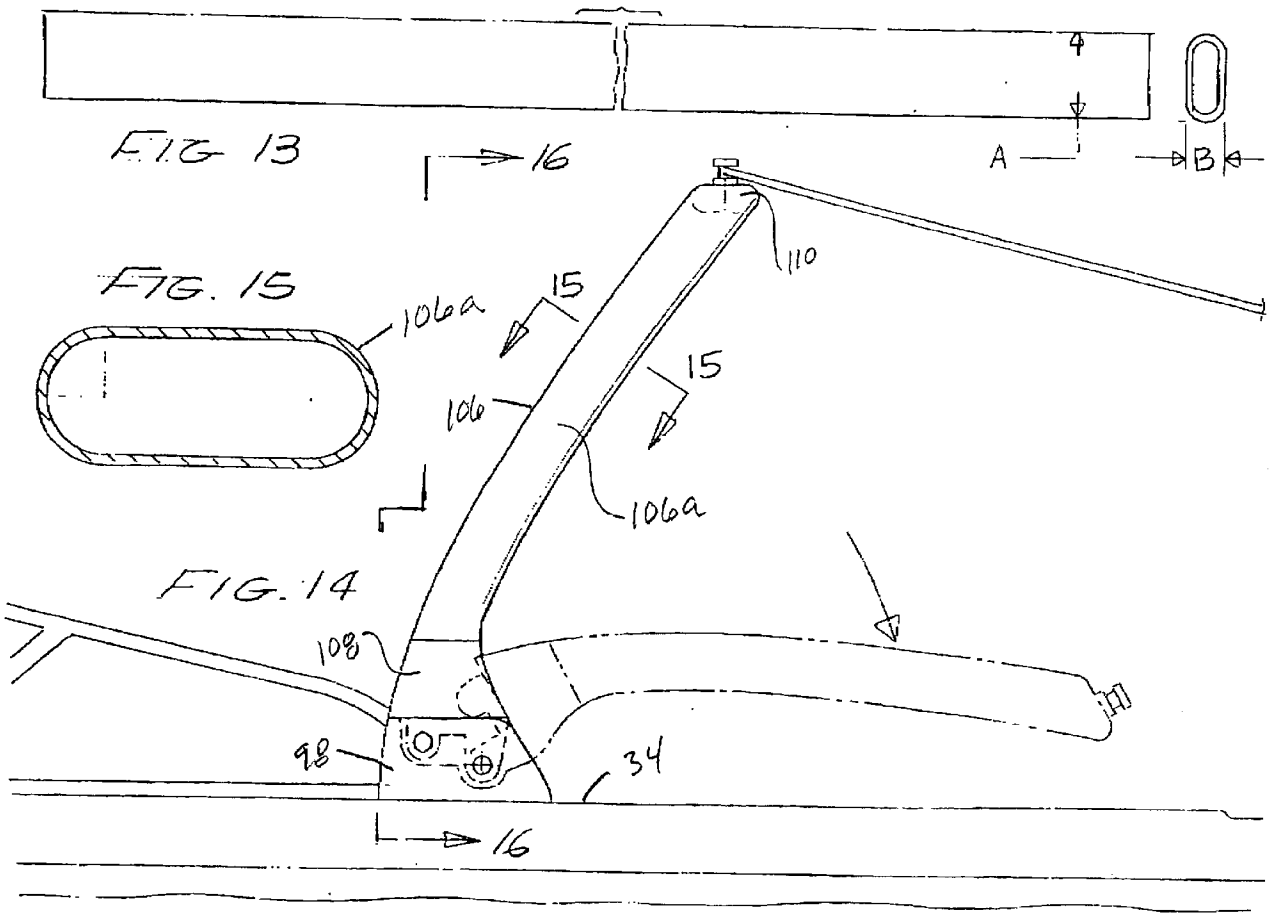
FIG. 13 is a side elevational view illustrating the manner of making one of the side members of the wake tower shown in FIG. 12.
FIG. 14 is a side elevational view of the wake tower of the alternate form of the invention shown in FIG. 12.
FIG. 15 is an enlarged, cross-sectional view taken along lines 15—15 of FIG. 14.

Turning next to FIGS. 12 through 21 an alternate form of the wake tower of the invention is shown and generally designated by the numeral 90. This embodiment is similar in many respects to the embodiment shown in FIGS. 1 through 11 and like numerals are used in FIGS. 12 through 21 to identify like components. One of the main differences between this latest form of the invention and the earlier described form resides in the fact that the wake tower slopes rearwardly instead of forwardly and instead of being pivotally movable toward the bow of the boat, is pivotally movable toward the stem of the boat as shown in FIG. 14 of the drawings.

Referring to FIG. 12 of the drawings, wake tower 90 is shown interconnected with a powerboat 30 of conventional construction having a bow portion 30*a*, a stem portion 30*b* and first and second spaced apart gunwales 32 and 34 respectively. In this latest form of the invention, the wake tower includes an upwardly extending first base member 96 that is connected to the first gunwale 32 and an upwardly extending second base member 98 that is connected to said second gunwale 34. The base members 96 and 98 are of a curved configuration and are preferably cast from a light-weight metal such as aluminum.

Interconnected with the base members is a generally U-shaped, upwardly extending structural assembly generally designated by the numeral 100. The structural assembly 100 includes a generally "L" shaped structural member 102 having a first curved side 102*a* and a cast aluminum first connector segment 104. Structural member 102 is connected to aluminum first connector segment 104 by any suitable means such as welding. In a manner presently to be described, connector segment 104 is, in turn, pivotally connected to first base member 96. Structural assembly 100 also includes a second generally "L" shaped structural member 106 having a curved side 106*a* and a second, cast aluminum connector segment 108 that is connected to second curved side 106*a* by any suitable means such as welding. Connector segment 108 is, in turn, pivotally connected second base member 98.

As in the earlier described embodiment of the invention, each of the sides of structural assembly 100 is first swaged into the desired configuration and then is strategically formed to create an elongated swaged portion having an oval shape (see FIGS. 13 and 15). As indicated in FIG. 14, in this latest form of the invention, the bight portion 110 of the structural assembly 100 is also generally oval shaped in cross-section. Unlike the earlier described embodiment of the invention, the tow rope TR is directly connected to a connector 112 that is connected to bight portion 110 proximate the center thereof.

Figures 18, 19, 20, 21:
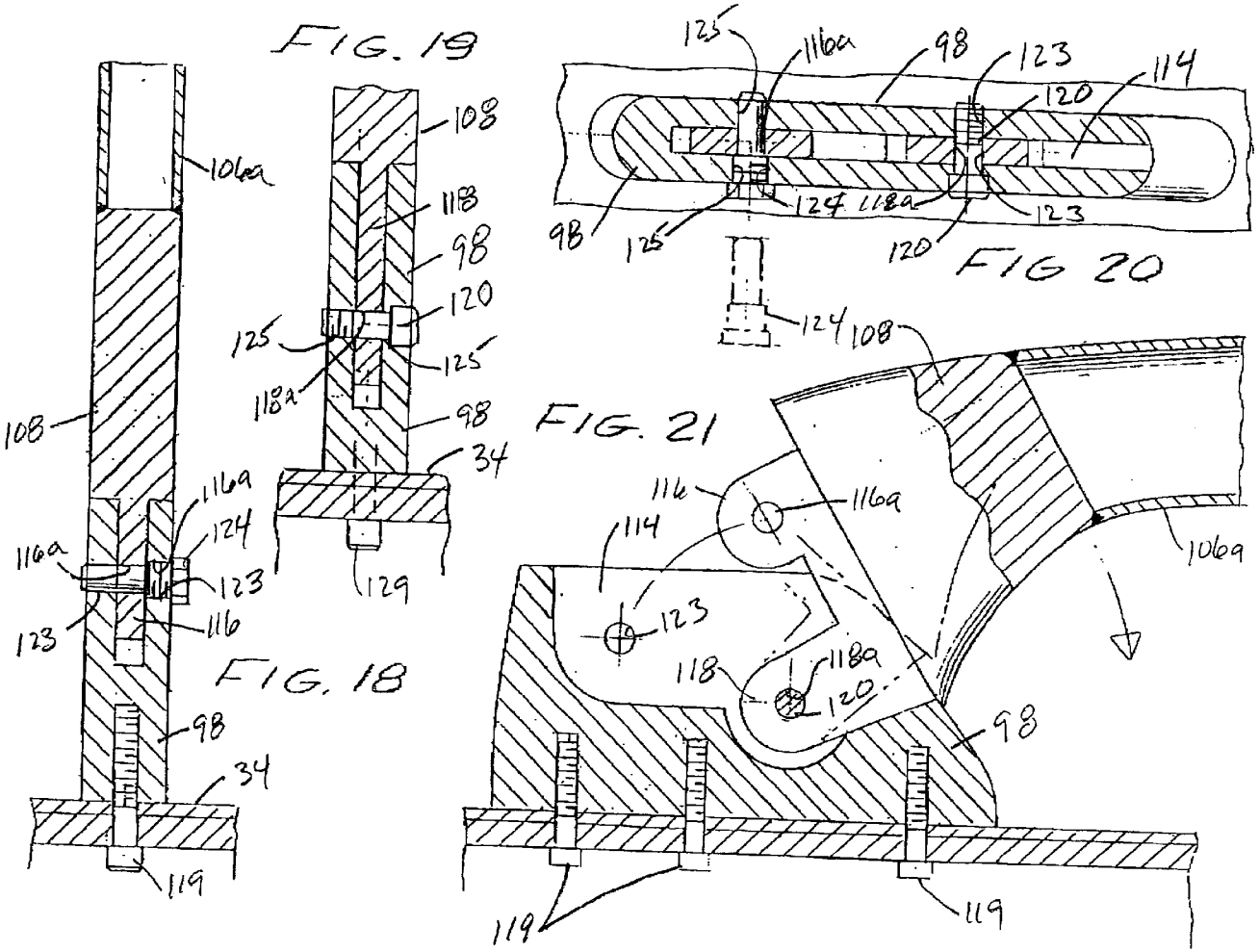
FIG. 18 is a cross-sectional view taken along lines 18—18 of FIG. 17.
FIG. 19 is a cross-sectional view taken along lines 19—19 of FIG. 17.
FIG. 20 is a cross-sectional view taken along lines 20—20 of FIG. 17.
FIG. 21 is a fragmentary cross-sectional view similar to FIG. 17, but illustrating the rearward pivotal moment of the wake tower of the alternate form of the invention.

Turning next to FIGS. 17 through 20, a portion of one side of the wake tower of this latest form of the invention is there shown. It is to be understood that the other side of the wake tower is of a similar construction, but is not shown in the drawings in order to simplify the specification. As best seen in FIGS. 17 and 20, each of the base members is provided with a cavity 114 and each of the connector segments is provided with a pair of spaced apart, downwardly extending ears 116 and 118 that are receivable within the base member cavities. As shown in FIG. 17, downwardly extending ear 116 has a bore 116*a* formed therein and, similarly, downwardly extending ear 118, which has a length greater than the length of the ear 116, has a bore 118*a* formed therein. Receivable within bore 118*a* is a pivot pin 120 about which side 106 and connector segment 108 can pivot in the manner shown in FIG. 21. As illustrated in FIGS. 19 and 20, pivot pin 120 extends through aligned bores 123 formed in base member 98. Similarly, a locking pin 124 is receivable within bore 116*a* formed in ear 116. Locking pin 124 extends through aligned bores 125 formed in base member 98 and, when in position within these openings in the manner shown in FIGS. 17 and 20, prevents pivotal movement of side 106 and connector segment 108 about pivot pin 120. As indicated by the phantom lines in FIG. 20, when the locking pin 124 is removed from the base member, the combination of side 106 and connector segment 108 is free to pivot about pivot pin 120 in the manner shown in FIG. 21.

In accordance with an alternate form of the method of making the wake tower illustrated in FIGS. 12 through 21, the first and second base members 96 and 98 are cast in a conventional manner from a suitable lightweight castable material such as aluminum and are appropriately finished.

This done, the base members can be interconnected with the powerboat by a plurality of threaded connectors 129 in the manner shown in FIG. 17.

The side members 102*a* and 106*a* are each formed individually by first heating to an elevated, annealing temperature a first length of tubing, such as 6061-T6 aluminum tubing that has a diameter of approximately 5 inches. The heated length of tubing is swaged in a conventional manner well known to those skilled in the art to form a first swaged tube 130 of the general configuration shown in FIG. 12. Using an appropriate forming dye, the swaged tube 130 is strategically formed so that it is generally oval shaped in cross-section. This swaging step is done in a conventional manner using conventional tooling that is of the character well understood by those skilled in the art. Following the swaging step, the swaged to first tube 130 is strategically bent into the desired shape to form a first bent tube that is generally "L" shaped in configuration and generally corresponds to the shape of member 102*a*.

Next, first connector segment 104 is cast in a conventional manner from a light weight castable material such aluminum and is connected by any suitable means such as welding to the bent tube formed by the swaging step to form a first wake tower subassembly 102, which generally corresponds to one-half of the structural assembly 100.

Following the forming of the first wake tower subassembly, a second length of aluminum tubing is swaged and formed in the identical manner described in the preceding paragraphs to produce a second side 106*a*. This done, second connector segment 108 is suitably cast from a light weight metal such as aluminum and is interconnected as by welding was second side 106*a* to form assembly 106 that generally corresponds to the second half of the structural assembly 100.

Next, the first and second wake tower subassemblies 102 and 106 are interconnected at their ends as by a welding to form the structural member 100. After completing the construction of the structural member 100 in the manner described in the preceding paragraphs, the structural member is pivotally interconnected with the base members 96 and 98 as illustrated in FIGS. 6 through 10 of the drawings to form the construction shown in FIGS. 12 and 16. More particularly, the ears formed on each of the connector segments are inserted into the base cavities, the pivot pins 120 are inserted into bores 123 and 118*a* and the locking pins are inserted into bores 125 and 116*a*. With this construction, when it is desired to pivot the structural member rearwardly into the stowed position in the manner illustrated by the phantom lines in FIG. 14, locking pin 124 is removed from bores 125 and 116*a* to permit the structural member to pivot about pivot pin 120.

Referring to FIGS. 22 through 27, still another form of the wake tower of the invention is there shown and generally designated by the numeral 140. This embodiment is also similar in many respects to the embodiment shown in FIGS. 1 through 11 and like numerals are used in FIGS. 12 through 21 to identify like components. The main differences between this latest form of the invention and that earlier described resides in the fact that the wake tower is cast by conventional casting techniques from a lightweight metal such as aluminum or from other suitable castable materials such as plastic.

Referring to FIG. 25 of the drawings, wake tower 140 is interconnected with a powerboat 30 of the previously described, conventional construction having a bow portion, a stern portion and first and second spaced apart gunwales. As before, the wake tower includes an upwardly extending first base member 36 that is connected to the first gunwale and an upwardly extending second base member 38 that is connected to said second gunwale. The base members are of a curved configuration and are also preferably cast from a lightweight material such as aluminum or the like.

Interconnected with the base members is a generally U-shaped, upwardly extending structural assembly generally designated by the numeral 142. The structural assembly 142 includes a pair of generally "L" shaped structural members each having a curved side 142*a* and a connector segment 142*b* that includes a basewall 142*c* that closes the lower extremity of the curved sides 142*a*.The connector segments 142*b* are pivotally connected to the first and second base members in the manner previously described to enable the structural assembly to be pivoted into the stowed position as illustrated in FIG. 4. More particularly, as earlier discussed herein, the ears 62 and 64, which form a part of the connector segments, are inserted into the base cavities 60, the pivot pins 66 are inserted into bores 62*a* and the locking pins are inserted into bores 64*a*. With this construction, when it is desired to pivot the structural member into the stowed position in the manner previously described, locking pins 72 are removed from bores 73 to permit the structural member to pivot about pivot pins 66.

Figure 22:
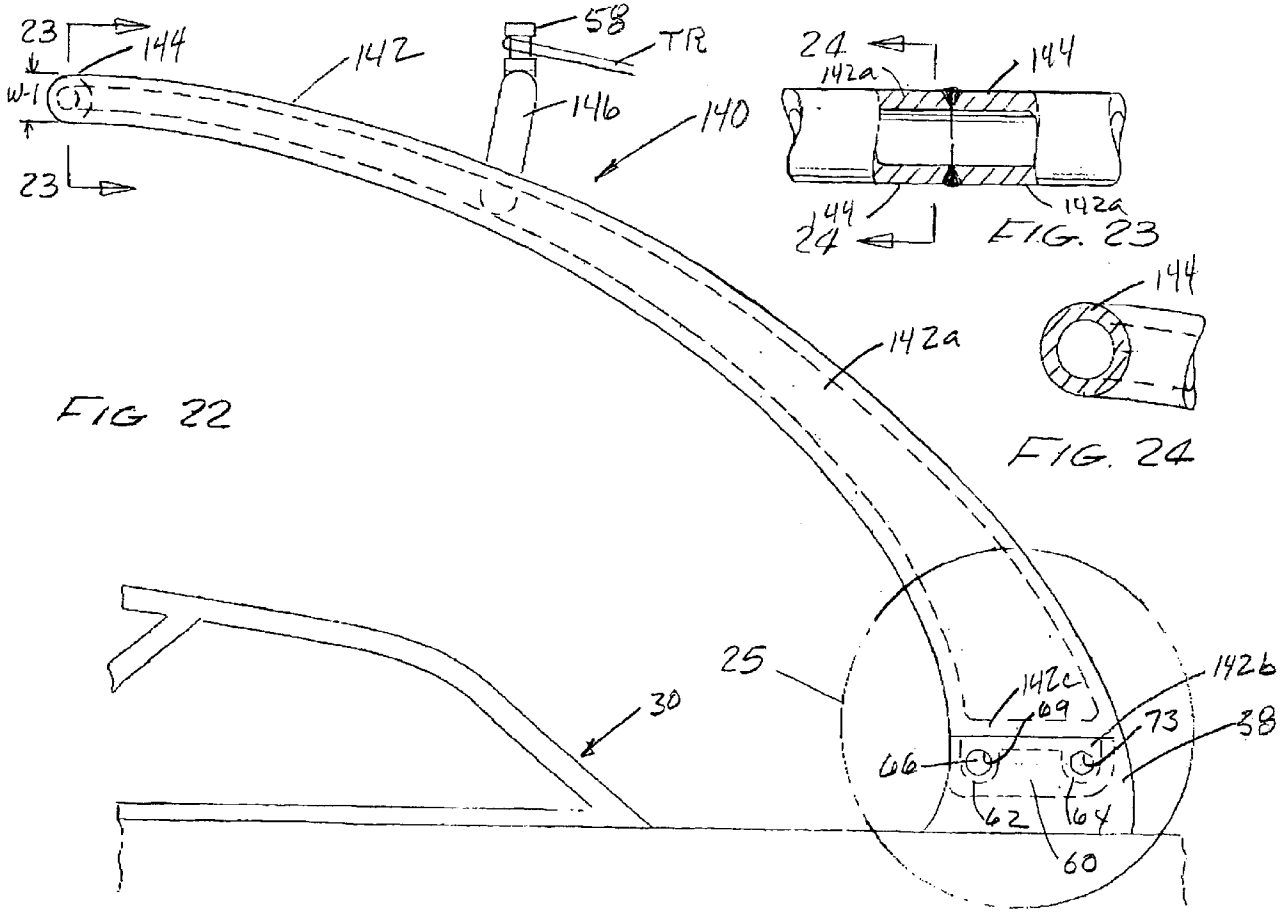
FIG. 22 is a side elevational view of still another form of the wake tower of the invention that is cast from a metal such as aluminum.

As best seen in FIGS. 22 and 25, each of the sides of the structural assembly 140 includes a lower portion having a first width W and an upper portion having a second width W-1 that is substantially less than said first width W. Structural assembly 140 further includes a bight portion 144 that interconnects the upper portions of the sides (FIG. 22). As indicated in FIGS. 22, 23 and 24, bight portion 144 is generally circular in cross-section. At the time of assembly of the structural assembly 142, the bight portions are interconnected together by any suitable means such as welding (see FIG. 23). As illustrated in FIG. 26, the sides of the structural assembly are generally oval in cross-section. It is to be understood that the two sides of the wake tower 140 are of a similar construction, but only one side a shown in the drawings in order to simplify the specification.

In this latest form of the invention, like the form of the invention shown in FIGS. 1 through 11, the wake tower 140 further includes a tow rope connector member 146 that is connected to and spans upper portion of the sides 142*a*. Connected to the connector member 146 is a conventional type of connector 58 to which the towrope "TR" can be connected.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In combination, a sports boat having first and second spaced apart gunwales, a bow portion and a stern portion a wake tower, said wake tower comprising:

(a) an upwardly extending first base member connected to the first gunwale of the sports boat, said first base member having a cavity and a pivot pin;

(b) an upwardly extending second base member connected to said second gunwale of the sports boat, said second base member having a cavity and a pivot pin;

(c) a generally U-shaped, upwardly extending structural assembly having a first curved side connected to said first base member and a second curved side connected to said second base member, each of said sides having an upper portion and a lower portion, each of which is generally oval in cross-section, said lower portion of each of said sides having a first width and said upper portion of each of said sides having a second width less than said first width, said lower portion of each said first and second sides including a connector segment having at least one downwardly extending ear receivable within a selected one of said cavities in said first and second base members and pivotable about a selected pivot pin.

2. The combination as defined in claim 1 in which said generally U-shaped, upwardly extending structural assembly further includes a bight portion interconnecting said upper portions of said sides, said bight portion being generally circular in cross-section.

3. The combination as defined in claim 1 in which said generally U-shaped, upwardly extending structural assembly further includes a connector member connected to and spanning said upper portions of said sides.

4. The combination as defined in claim 1 in which said generally U-shaped, upwardly extending structural assembly further includes a connector strut connected to and spanning said upper portions of said sides.

5. The combination as defined in claim 1 in which said generally U-shaped upwardly extending assembly is pivotally movable in a direction toward the bow portion of the sports boat.

6. The combination as defined in claim 1 in which said generally U-shaped, upwardly extending assembly is pivotally movable into direction toward the stern portion of the sports boat.

7. A method of making a wake tower comprising the steps of:

(a) casting a first base member from a castable material;

(b) casting a second base member from a castable material;

(c) heating a first length of tubing having a first end and a second end and a first diameter to an elevated temperature;

(d) swaging said first length of tubing to form a first swaged tube having a tapered swaged portion having a first end of said first diameter and a second end of a second lesser diameter and a uniform diameter portion having a diameter substantially equal to said second lesser diameter;

(e) using a forming dye, forming said tapered swaged portion of said first swaged tube to produce a tapered swaged portion that is generally oval shaped in cross-section to produce a first formed tube having a tapered swaged portion and an elongated uniform diameter portion;

(f) bending said first formed tube to form a first bent tube that is generally "L" shaped in configuration;

(g) casting a first connector segment from a castable material;

(h) connecting said first connector segment to said first bent tube to form a first side tube assembly;

(i) interconnecting said first side tube assembly with said first base member to form a first wake tower subassembly having a tapered swaged portion and an elongated uniform diameter portion;

(j) heating a second length of tubing having a first end and a second end and a first diameter to an elevated temperature;

(k) swaging said second to length of tubing to form a second swaged tube having a tapered swaged portion having a first end of said first diameter and a second end of a second lesser diameter and a uniform diameter portion having a diameter substantially equal to said second lesser diameter;

(l) using a forming dye, forming said tapered swaged portion of said second swaged tube to produce a tapered swaged portion that is generally oval shaped in cross-section to produce a second formed tube having a tapered swaged portion and an elongated in uniform diameter portion;

(m) bending said second formed tube to form a second bent tube that is generally "L" shaped in configuration;

(n) casting a second connector segment from a castable material;

(o) connecting said second connector segment to said second bent tube to form a second side tube assembly having a tapered swaged portion and an elongated in uniform diameter portion;

(p) interconnecting said second side tube assembly with said second base member to form a second wake tower subassembly having a tapered swaged portion and an elongated uniform diameter portion; and (q) connecting said uniform diameter portion of said first wake tower subassembly to said uniform diameter portion of said second wake tower subassembly.

8. The method as defined in claim 7 in which said first side tube assembly is pivotally interconnected with said first base member and in which said second side tube assembly is pivotally interconnected with said second base member.

9. The method as defined in claim 7 in which said first side tube assembly is pivotally interconnected with said first base member and in which said second side tube assembly is pivotally interconnected with said second base member.

10. In combination, a sports boat having first and second spaced apart gunwales, a bow portion and a stern portion, a wake tower, said wake tower comprising:

(a) an upwardly extending first base member connected to the first gunwale of the sports boat, said first base member having a cavity formed therein;.

(b) an upwardly extending second base member connected to second gunwale of the sports boat, said second base member having a cavity formed therein;

(c) a generally U-shaped, upwardly extending structural assembly connected to said first and second base members, said generally U-shaped upwardly extending structural assembly comprising;

(i) a first curved side having an upper portion and a lower portion, each of said upper and lower portions being generally oval in cross-section;

(ii) a first connector segment connected to said first curved side and pivotally connected to said first base member, said firsts connector segment including a first pair of spaced apart, downwardly extending ears receivable within said cavity of said first base member, each of said downwardly extending ears of said first pair of ears having an opening formed therein;

(iii) a second curved side having an upper portion and a lower portion, each of said upper and lower portions being generally oval in cross section;

(iv) second connector segment connected to said second curved side and pivotally connected to said second base member, said second connector segment including a second pair of spaced apart, downwardly extending ears receivable within said cavity of said second base member, each of said downwardly extending ears of said second pair of ears having an opening formed therein; and (v) a bight portion interconnecting said upper portions of first and second curved sides.

11. The combination as defined in claim 10 in which said first base member has pair of spaced apart openings formed therein and in which said wake tower further includes a first pair of pins extending through said spaced apart openings in said first base member and into said openings formed in said first pair of ears of said first connector segment and in which said second base member has pair of spaced apart openings formed therein and in which said wake tower further includes a second pair of pins extending through said spaced apart openings in said second base member and into said openings formed in said second pair of ears of said second connector segment.

12. A wake tower comprising (a) a first base member;

(b) a second base member (c) a generally U-shaped, structural assembly having a first curved side connected to said first base member and a second curved side connected to said second base member, each of said sides having an upper portion and a lower portion each of which is generally oval in cross-section, said lower portion of each of said sides having a first width and said upper portion of each of said sides having a second width less than said first width;

(d) a bight portion interconnecting said upper portions of said sides, said bight portion being generally circular in cross-section;

(e) a connector segment connected to said first curved side, said first connector segment having a first pair of spaced apart ears; and (f) a second connector segment connected to said second curved side, said second connector segment having a second pair of spaced apart ears.

13. The wake tower as defined in claim 12 in which said generally U-shaped structural assembly further includes a towrope connector strut connected to and spanning said upper portions of said sides.

14. The wake tower as defined in claim 12 in which said generally U-shaped structural assembly is pivotally connected to said first and second base members for pivotal movement between a first position and a second position.

15. The wake tower as defined in claim 12 in which said first base member includes a cavity for receiving said first pair of spaced apart ears of said first connector segment and in which said second base member includes a cavity for receiving said second pair of spaced apart ears of said second connector segment.

* * * * *